United States Patent [19]

Fester

[11] Patent Number: 4,680,448

[45] Date of Patent: Jul. 14, 1987

[54] INFRARED SPACE HEATER

[76] Inventor: Earl L. Fester, Rte. 7, Box 307, Springfield, Mo. 65802

[21] Appl. No.: 837,254

[22] Filed: Mar. 7, 1986

[51] Int. Cl.[4] ..... H05B 1/00; F24H 3/02

[52] U.S. Cl. ..... 219/365; 219/342; 219/368; 219/370; 219/377; 126/110 R; 165/123; 165/179; 165/185

[58] Field of Search ..... 219/359, 361, 365–371, 219/374, 377, 378, 342, 343; 237/16–18, 185, 179, 123; 126/110 R; 165/123, 179, 185

[56] References Cited

U.S. PATENT DOCUMENTS

| | | | |
|---|---|---|---|
| 3,165,624 | 1/1965 | Cunningham | 219/365 |
| 3,180,972 | 4/1965 | Covault . | |
| 3,575,582 | 4/1971 | Covault . | |
| 4,197,447 | 4/1980 | Jones . | |
| 4,307,284 | 12/1981 | Perron | 219/365 X |
| 4,309,594 | 1/1982 | Jones . | |

*Primary Examiner*—Roy N. Envall, Jr.
*Attorney, Agent, or Firm*—Nixon & Vanderhye

[57] ABSTRACT

A space heating device which utilizes infrared lamps has enhanced heat transfer, and achieves an air flow velocity increase of approximately 30 percent, resulting in increased efficiency. A heat exchanger comprising a plurality of spaced, parallel copper tubes, and a plurality of spaced, parallel aluminum fins connected and extending perpendicular to the tubes, is mounted above the infrared lamps and in an air flow path within a casing so that air is circulated by a fan from a cool air inlet, past the lamps, beneath, around, and above the heat exchanger, through the tubes of the heat exchanger, and through the spaces between the fins and tubes, to the heated air outlet. Bottom portions of the fins are coated with black carbon paint to enhance heat transfer, and curved deflectors are provided adjacent the bottom of the lamps and adjacent the top of the heat exchanger on one end thereof, to facilitate guiding of the air in a generally S-shaped path through the casing. The fan is electrically connected to the lamps so that when one is on, all are on, and a thermostat responsive to ambient temperature adjacent the fan controls the fan and lamps. A high temperature switch placed within the casing cuts off the 120 volt supply of current to the fan and lamps if the temperature in the casing exceeds a predetermined level.

20 Claims, 5 Drawing Figures

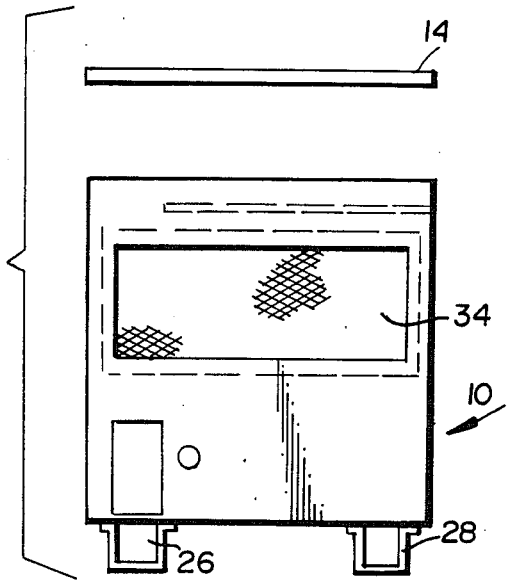
FIG. 4
FIG. 3
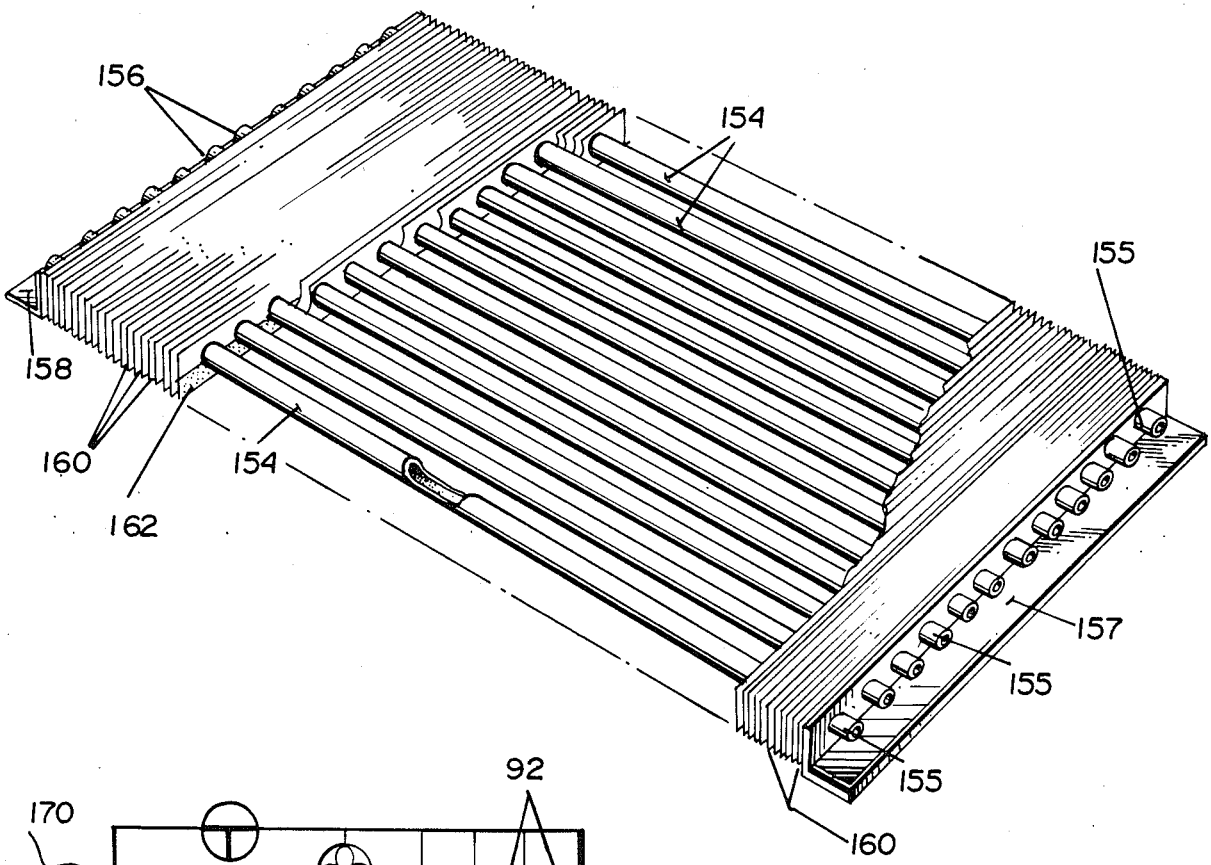
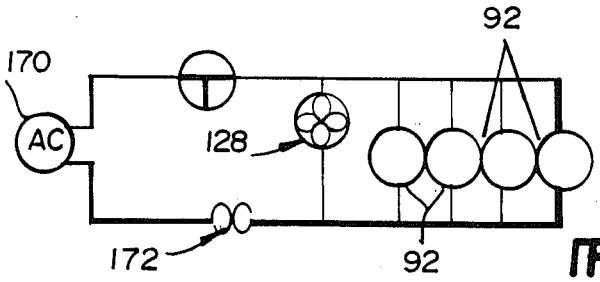
FIG. 5

INFRARED SPACE HEATER

Space heaters which utilize infrared lamps as the heat source and provide positive circulation of air through a casing containing the infrared lamps have been shown to be a practical, effective, and relatively efficient electrically powered space heating source. Such units provide economy, comfort, and safety for a wide variety of residential and commercial environments. Exemplary space heaters of this type are shown in U.S. Pat. Nos. 3,575,582 and 4,309,594.

While conventional infrared lamp space heaters are effective, it is desirable to be able to enhance the efficiency of the units to even greater levels than are presently provided. Also, it is desirable to provide for simplified control of operation of such units so that a minimum number of controls, and minimum possibility for failure, are provided.

According to the present invention, a space heater is provided which has enhanced effectiveness compared to prior art infrared lamp space heaters. The space heater according to the invention has an improved heat exchanger mounted adjacent the infrared lamps which increases by six times the amount of heat transfer provided thereby compared to prior conventional units, and when properly positioned in the space heater casing can result in air flow velocities out of the casing which are increased approximately 30 percent (with the same fan) as compared to conventional space heaters. These changes of course result in increased efficiency and uniformity on the delivery of heat to a space.

The improved heat exchanger utilized in the present invention includes a plurality of spaced, parallel tubes of high heat conductivity material (such as copper) and a plurality of spaced, parallel fins also of high heat conductivity material (such as aluminum) which connect and extend perpendicular to the tubes. The heat exchanger is mounted directly above the infrared lamps, and in air passageway whereby air flows through the spaces between the fins and tubes, into a first end of the tubes and then through the tubes toward the heated air outlet, and in a path past the bottom of the heat exchanger, around one end thereof, and past the top thereof. To facilitate even transfer of heat by the heat exchanger, curved deflectors are provided adjacent the bottoms of the lamps, and adjacent the top at one end of the heat exchanger, so that the air flow is in a generally S-shaped path.

Simplified control of the electrical components of the space heater according to the invention is also provided. The fan and the infrared lamps are electrically connected so that when one is on, all are on. They are controlled by a thermostat which is sensitive to the ambient temperature (preferably being disposed adjacent the fan) and are powered by a conventional 120 volt a.c. line. A high temperature switch is disposed within the casing to cut off power to the components should the temperature within the casing exceed a predetermined maximum (e.g. 200°-210° F.).

It is the primary object of the present invention to provide an enhanced efficiency and simplified-controlled space heater. This and other objects of the invention will become clear from an inspection of the detailed description of the invention, and from the appended claims.

BRIEF DESCRIPTION OF THE DRAWINGS

FIG. 3 is a perspective view, with portions cut away for clarity of illustration, of the heat exchanger utilized in the space heater of FIGS. 1 and 2;

FIG. 4 is an end view of the outside of the casing of the space heater of FIGS. 1 and 2, with the top removed; and FIG. 5 is an electrical schematic showing controls of components of the space heater of FIGS. 1 and 2.

DETAILED DESCRIPTION OF THE DRAWINGS

Figure 1:
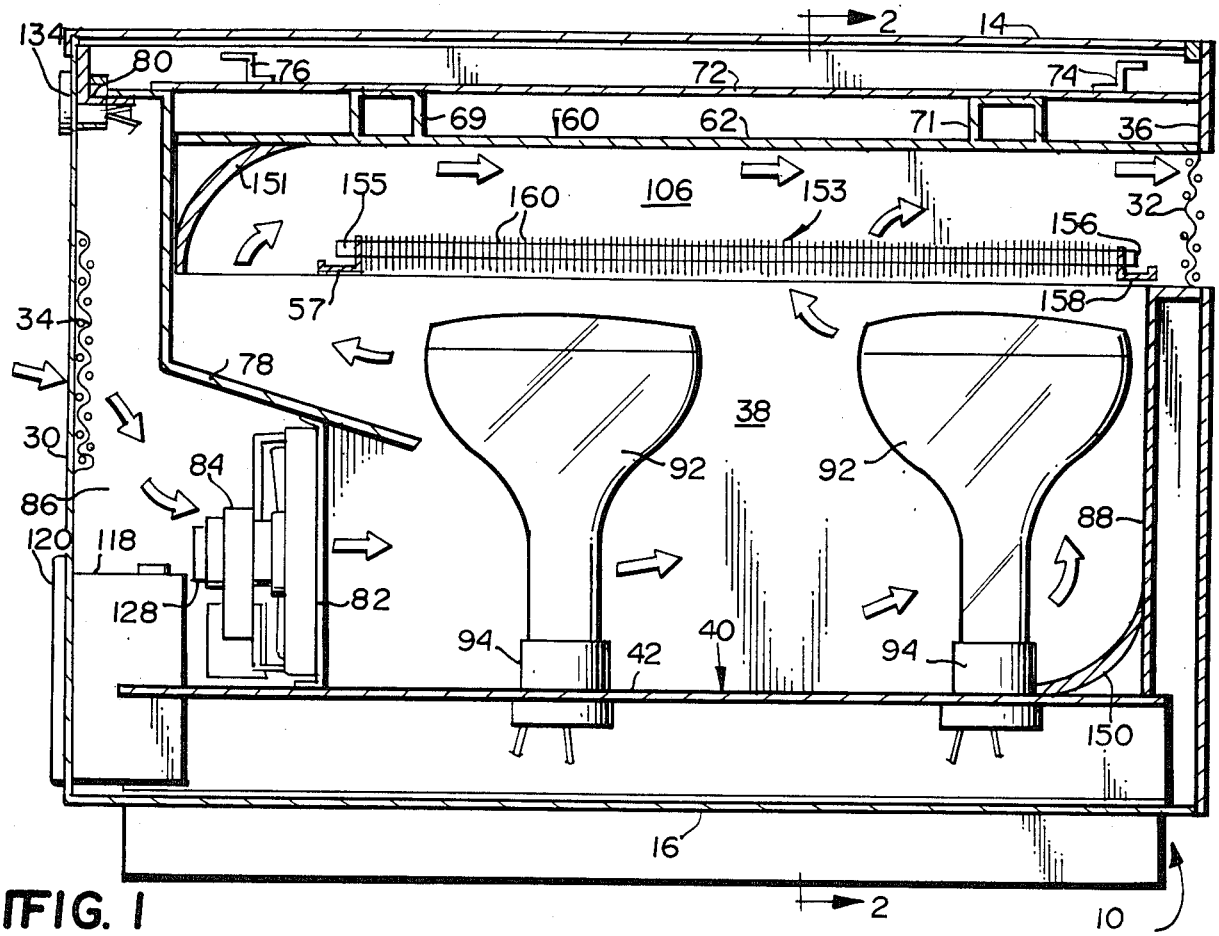
FIG. 1 is a side cross-sectional view of an exemplary space heater according to the present invention.
Figure 2:
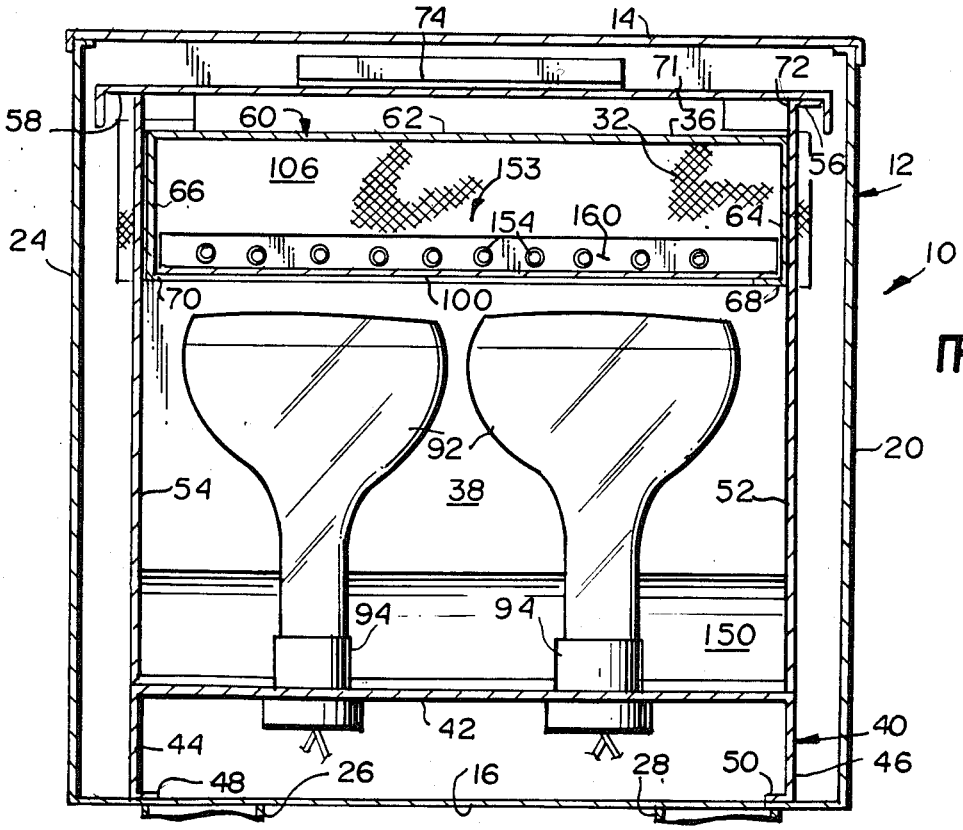
FIG. 2 is a longitudinal cross-sectional view of the space heater of FIG. 1 taken along lines 2—2 thereof.

The exemplary space heater 10 illustrated in FIGS. 1 and 2 includes many components in common with the space heater illustrated in U.S. Pat. No. 4,309,594. For example the unit includes a casing 12 having a bottom 16, a removable top 14, sidewalls 20 and 24, and end walls 18 and 22. Disposed in end wall 18 is a cool air inlet to the casing 12, preferably defined a grill 34, while in the end wall 22 a heated air outlet from the casing is provided, preferably defined by grill 32. Provided in the end 18 is an opening 119 through which a conventional electrical cord (not shown) extends for connecting the electrical components within the casing 12 to a conventional household 120 volt a.c. line. Legs 26, 28 may be provided for supporting the casing 12.

Other conventional components of the space heater 10 illustrated in the drawings include a fan 84 mounted within the casing by mounting piece 82, including to interior end wall 78, the fan 84 being driven by electric motor 128, and also supported on interior floor 40. An electrically powered heat source is provided within the casing which is preferably provided by a plurality of infrared lamps 92 which are mounted by lamp sockets 94 in the floor 40. Above the heating chamber 38 are various other casing components including a ceiling unit 60 including U-shaped support brackets 69, 71, support plates 72, and handles 74, 76 which can used to remove the ceiling structure 60 from within the casing. Support plate 72 of the unit 60 is normally supported by interior casing components 56, 58, with side portions 64 extending downwardly from plate 72. The side portions 64 are bent inwardly at 68, 70 to provide support for a heat exchanger.

According to the present invention a heat exchanger 153 is provided in the casing 12. The heat exchanger 153 according to the invention includes a plurality of spaced, parallel tubes 154 of high heat conductivity material, such as copper. The tubes each have a first end 155 thereof, and a second end 156, and a pair of angle mounting brackets 157, 158 are provided adjacent the ends 155, 156 respectively for mounting the heat exchanger above the lamps 92. The heat exchanger 153 further comprises a plurality of spaced parallel fins 160 of high heat conductivity material, such as aluminum, which are connected and extend perpendicular to the tubes 154. The fins 160 preferably are very thin, for example on the order of 0.005 of an inch, and about 14–18 fins per inch would typically be provided.

An air passageway defining means is provided by components heretofore described, and by the curved deflectors 150, 151, interior end wall 88, and interior side walls 52, 54 (see FIGS. 1 and 2). The air passageway defining means define a path of air movement so that cool air is drawn in through inlet grill 34, under the force of fan 84, is circulated passed the lamps 92, is deflected smoothly and efficiently upwardly by the curved deflector 150, past the lamps 92, under the heat exchanger 153, through the spaces between the fins 160 and tubes 154, around the end of heat exchanger 153 at which the tube first ends 155 are provided, is smoothly deflected back toward the heated air outlet by the curved deflector 151 so that it moves across the top of the heat exchanger 153, and then passes outwardly from the casing through the grill 32. Note also that some of the air flows into the tubes 154 at the first ends 155 thereof, and then passes outwardly from the tubes through the second ends 156 thereof. Flow of air in this way through the tubes is enhanced by the thermosiphonic effect.

The curved deflectors 150, 151 may be attached within the casing in any manner desired. For instance the deflector 150 may be welded to inner portions of the casing, such as the sidewalls 54 and end wall 88. A curved deflector 51 could be welded to the sidewall 64 of the ceiling unit 60, or alternatively could be welded to the wall portion 78.

In order to enhance heat transfer by the heat exchanger 153 even further, a coating of black carbon paint 162 (see FIG. 3) may be provided on at least the bottom portions of the fins 160. In this way the bottom portions of the fins 160, which are closest to the lamps 92, will take up even more heat, and transfer that heat to air flowing between the fins, beneath the fins, and even over the fins since the heat absorbed thereby will be conducted readily to the tops of the fins.

Due to the use of the heat exchanger 153 according to the present invention, the positioning of the heat exchanger in the casing 12, and the curved deflector plates 150, 151, it is possible to greatly increase the heat transfer of the heat from the lamps 92 to the air circulating within the casing 12. The effective heat transfer area of the heat exchanger 153 increases by six times the effective heat transfer area of conventional heat exchangers, such as shown in U.S. Pat. No. 4,309,594. Also, the components and relative positioning of the components as heretofore described results in an increase in the air flow velocity (for the same size fan 84) of approximately 30 percent compared to conventional infrared space heaters, a significant advantage.

FIG. 5 illustrates the simplified electrical circuitry means associated with the space heater according to the invention. Note that the fan motor 128 and the lamps 92 are connected to the conventional 120 volt a.c. source 170 so that if one is energized, they all are energized. A thermostat 171 controls the electrical components 92, 128 and responds to a sensed ambient temperature. Preferably the thermostat 171 is disposed adjacent the fan 84, as on the junction box 118 as illustrated in FIG. 1. The thermostat can be set, for example, at 70°, so that when the temperature of the air in the ambient environment falls below that the thermostat energizes the fan 128 and the lamps 92.

For safety, preferably a high temperature switch 172 is provided disposed at any suitable location within the heating chamber 38. If the temperature in the chamber 38 exceeds a predetermined level (e.g. 200°–210° F.), then the switch 172 will automatically cut out the electrical components 92, 128. The switch 172 is particularly useful for de-energizing the lamps 92 should the fan motor 128 stop for any reason.

It will thus be seen that according to the present invention an infrared space heater has been provided with enhanced efficiency and simplified controls. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A space heater comprising:

a casing having a cool air inlet and a heated air outlet;

a fan disposed within said casing adjacent said cool air inlet;

an electrically powered heat source disposed within said casing between said fan and said heated air outlet;

a heat exchanger mounted adjacent said electrically powered heat source;

air passageway defining means for defining a path of air movement through the casing from the cool air inlet, past the heat source, through and past the heat exchanger, and out the heated air outlet; and said heat exchanger comprising a plurality of spaced parallel tubes of high heat conductivity material elongated in a dimension leading from the interior of said casing to said heated air outlet, and a plurality of spaced parallel fins of high heat conductivity material, said fins connected to said tubes and extending perpendicular thereto.

2. A space heater as recited in claim 1 further comprising means for mounting said heat exchanger above said heat source and in a position so that air is drawn through said tubes from a first end thereof remote from the heated air outlet to be discharged through a second end thereof adjacent the heated air outlet for disposition in the air passageway defining means past the heat exchanger; through the spaces between the tubes and fins; and past the bottom, around the end at which said first ends of said tubes are disposed, and past the top of said heat exchanger.

3. A space heater as recited in claim 2 wherein said mounting means comprises an angle mounting bracket provided in operative association with each of the first and second ends of said tubes and connecting said tubes to said casing.

4. A space heater as recited in cliam 2 wherein said heat source comprises a plurality of infrared lamps.

5. A space heater as recited in claim 4 wherein at least bottom portions of said heat exchanger fins have a coating of black carbon paint to enhance heat transfer.

6. A space heater as recited in claim 5 wherein said fins are of aluminum and said tubes are of copper.

7. A space heater as recited in claim 1 wherein said heat exchanger fins are aluminum and said heat exchanger tubes are copper.

8. A space heater as recited in claim 7 wherein said heat exchanger has approximately 14–18 fins per inch.

9. A space heater as recited in claim 4 wherein said air passageway defining means includes a first curved deflector mounted adjacent a portion of said lamps for deflecting air upwardly past said lamps and through and around said heat exchanger.

10. A space heater as recited in claim 9 wherein said air passageway defining means further comprises a second curved deflector disposed adjacent and above said first ends of said tubes for deflecting the flow of air past said lamps toward said heated air outlet, and cooperating with said first curved deflector and said fan to effect a flow of air past said lamps in the bottom of said heat exchanger, around the end of said heat exchanger wherein said first ends of said tubes are provided, and past the top of said heat exchanger, defining a generally S-shaped path.

11. A space heater comprising:

a casing having a cool air inlet and a heated air outlet;

an electrically powered fan disposed in said casing adjacent said cool air inlet;

a plurality of infrared lamps mounted within said casing between said fan and said heated air outlet;

a heat exchanger mounted adjacent said lamps;

air passageway defining means for defining a path for air movement through the cool air inlet, past the lamps, through and past the heat exchanger, and out the heated air outlet; and electrical circuitry means consisting essentially of means for connecting said lamps and a fan so that when one is energized, all are energized; a thermostat for controlling energiztion and de-energization of said lamps and fan in response to ambient temperature; and a high temperature switch means mounted within said casing and cutting off electrical power to said lamps should the temperature in said casing exceed a predetermined level.

12. A space heater as recited in claim 11 wherein said thermostat is mounted adjacent said fan for sensing the ambient temperature adjacent said fan.

13. A space heater as recited in claim 12 wherein the source of electrical power for said electrical circuitry means comprises a 120 volt a.c. line.

14. A space heater as recited in claim 11 wherein said heat exchanger comprises a plurality of spaced parallel tubes of high heat conductivity material elongated in a dimension leading from the interior of said casing to said heated air outlet, and a plurality of spaced parallel fins of high heat conductivity material, said fins connected to said tubes and extending perpendicular thereto.

15. A space heater as recited in claim 14 further comprising means for mounting said heat exchanger above said infrared lamps and in a position so that air is drawn through said tubes from a first end thereof remote from the heated air outlet to be discharged through a second end thereof adjacent the heated air outlet; through the spaces between the tubes and fins; and past the bottom, around the end at which said first ends of said tubes are disposed, and past the top of said heat exchanger.

16. A space heater as recited in claim 15 wherein at least bottom portions of said heat exchanger fins have a coating of black carbon paint to enhance heat transfer.

17. A space heater as recited in claim 14 wherein said heat exchanger fins are aluminum and said heat exchanger tubes are copper.

18. A space heater as recited in claim 14 wherein said air passageway defining means includes a first curved deflector mounted adjacent a portion of said lamps for deflecting air upwardly passed said lamps and through and around said heat exchanger.

19. A space heater as recited in claim 18 wherein said air passageway defining means further comprises a second curved deflector disposed adjacent and above said first ends of said tubes for deflecting the flow of air past said lamps toward said heated air outlet, and cooperating with said first curved deflector and said fan to effect a flow of air past said lamps in the bottom of said heat exchanger, around the end of said heat exchanger wherein said first ends of said tubes are provided, and past the top of said heat exchanger, defining a generally S-shaped path.

20. A space heater comprising:

a casing having a cool air inlet and a heated air outlet;

an electrically powered fan disposed in said casing adjacent said cool air inlet;

a plurality of infrared lamps mounted within said casing between said fan and said heated air outlet;

a heat exchanger mounted adjacent said lamps;

air passageway defiing means for defining a path for air movement through the cool air inlet, past the lamps, through and past the heat exchanger, and out the heated air outlet; and said heat exchanger comprising a plurality of spaced, parallel copper tubes connected to a plurality of spaced parallel aluminum fins having a heat transfer enhancing coating formed thereon on at least the portions thereof closest to said lamps, said heat exchanger being mounted so that said tubes lie generally parallel to the direction of air movement past said heat exchanger such that air is drawn through said tubes from a first end thereof remote from the heated air outlet for discharge through a second end thereof adjacent the heated air outlet and disposition in the air passageway defining means past the heat exchanger; through the spaces between the tubes and fins; and past the bottom, around the end at which said first ends of said tubes are disposed, and past the top of said heat exchanger.

* * * * *